United States Patent [19]

Hull

[11] Patent Number: 4,644,668

[45] Date of Patent: Feb. 24, 1987

[54] DRYER ROLL

[75] Inventor: Robert E. Hull, Richmond, Va.

[73] Assignee: E. I. Du Pont de Nemours and Company, Wilmington, Del.

[21] Appl. No.: 770,346

[22] Filed: Aug. 28, 1985

[51] Int. Cl.[4] ..... F26B 25/20

[52] U.S. Cl. ..... 34/119; 34/124

[58] Field of Search ..... 34/124, 125, 119, 152

[56] References Cited

U.S. PATENT DOCUMENTS

| | | | |
|---|---|---|---|
| 1,575,249 | 3/1926 | Berry et al. . | |
| 2,486,719 | 11/1949 | Messinger . | |
| 2,643,099 | 6/1953 | Kinraide et al. . | |
| 2,933,825 | 4/1960 | Small . | |
| 3,169,050 | 2/1965 | Kroon | 34/124 |
| 3,302,698 | 2/1967 | Edwards . | |
| 3,355,817 | 12/1967 | Birk | 34/124 |
| 3,619,539 | 11/1971 | Taylor . | |
| 4,501,075 | 2/1985 | Jenkner et al. | 34/125 |

*Primary Examiner*—Larry I. Schwartz

[57] ABSTRACT

A vapor heated roll used to heat material that spirally travels along the length of the roll has a vapor chamber that tapers from each end toward a specified location intermediate the ends to provide a chamber having an increasingly greater cross section from each end of the chamber to the specified location. A means for removal of condensate from the chamber is positioned at the location of largest diameter. The distance of the location for condensate removal from the point at which material enters upon the roll surface is calculated to provide maximum heating efficiency.

9 Claims, 3 Drawing Figures

DRYER ROLL

BACKGROUND OF THE INVENTION

This invention relates to vapor-heated rolls for drying or heating material passing thereover, and more particularly, it relates to vapor-heated rolls for handling variable drying loads along their length.

Rapidly rotating heated rolls are extensively used in continuous drying operations. Typical drying applications such as found in the paper industry require a uniform heat transfer or heat flux rate at each point along the cylindrical surface of the roll. In these processes, paper webs pass in a serpentine path over a series of rolls. In the case of rolls heated by condensation of vapor, such as steam, the rate of condensate generation at each point along the axis of the roll is uniform.

Other industrial drying processes treat webs or individual threadlines comprised of multiple filaments by laying the web or filaments onto one end of a drying roll and spirally advancing the product along the roll until it is removed from the opposite end of the roll to pass to the next treatment step in the process. In the manufacture of wet-spun yarns or those requiring aqueous washing or extracting before windup, a drying step is utilized wherein product enters upon a drying roll at a high moisture level and is progressively dried to the desired moisture level as it advances along the longitudinal axis of the roll. Conditions in the roll interior, where condensation is occurring, are different from those encountered in rolls used to dry paper. The heat transfer rate varies as the product is dried and therefore the rate of condensate generation varies. This requires a different method of managing condensate removal from the roll to compensate for the variable thickness of condensate which collects on the interior surface of the outside wall. The thicker the condensate layer, the lower is the heat transfer rate. Greatest heat transfer rate occurs close to the roll-end where yarn enters, and condensate build-up here severely reduces both the drying rate and production capacity. In the past, processes have depended on increased pressure difference between the supply and discharge sides of the roll heating chamber to convey condensate from the roll. This results in wasted steam since excess steam is required to convey condensate from the roll. This conveying steam is therefore unavailable to condense and provide energy for product drying. Prior methods of condensate removal did not minimize thickness of the film of condensate and therefore limited the rate at which product could be dried.

SUMMARY OF THE INVENTION

The drying roll of this invention provides increased drying capacity under the variable drying loads along the roll axis, both by managing condensate movement inside the roll heating chamber and by selecting the location from which condensate is removed from the heating chamber.

The roll comprises first and second concentric cylindrical walls spaced from each other and sealed at each end by plates to provide a chamber within the roll. The inner surface of the outer wall is tapered from each end of the roll to a specified location to provide a chamber that has a gradually increasing cross-sectional area from each end of the roll to said specified location. There is a rotatable supporting shaft attached to the inner wall of the roll. The supporting shaft has two concentric passages, one for steam and one for condensate. A condensate removal pipe is provided which, at one end, passes through the second wall into the chamber at said spcified location and, at its other end, communicates with the condensate-removal passage of the supporting shaft. Likewise, a steam-injection pipe is provided which, at one end, communicates with the chamber at a position remote from said specified location and, at its other end, communicates with the steam injection-passage of the supporting shaft. Preferably, the steam-injection pipe enters the chamber very close to the yarn exit end of the roll. More preferably, there are two condensate-removal pipes angularly spaced 180 degrees apart, and one steam-injection pipe angularly spaced midway between the two condensate-removal pipes. The distance of said specified location from the end of the roll that the yarn enters upon is from about 20 to 40 percent of the total length of the roll, preferably the distance is about 30 percent.

DETAILED DESCRIPTION OF THE ILLUSTRATED EMBODIMENT

Figure 1:
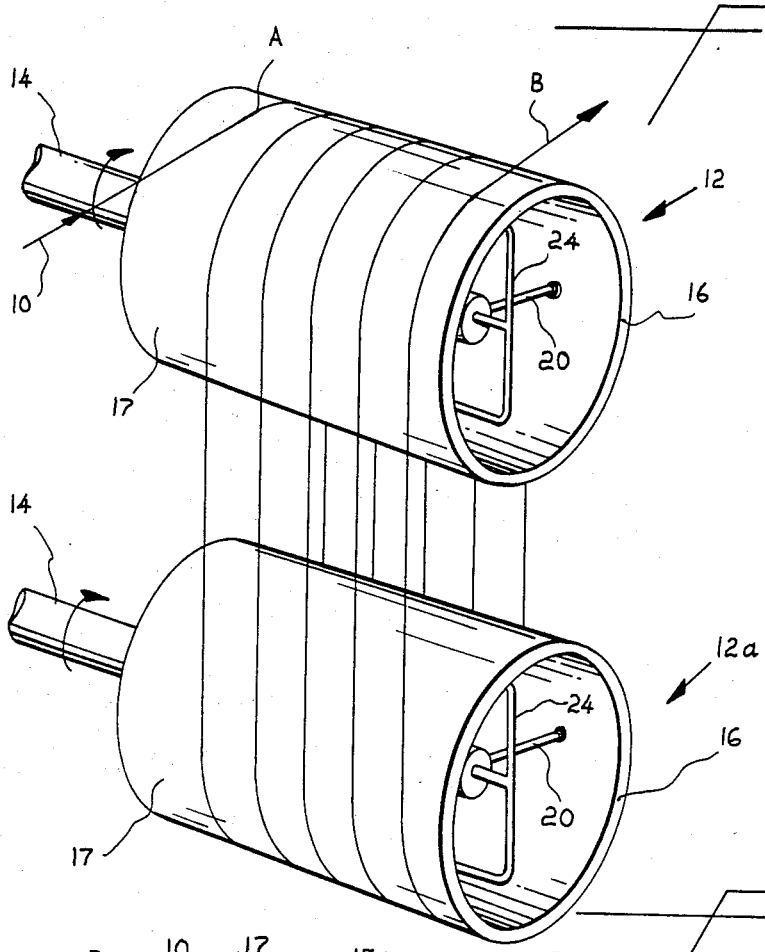
FIG. 1 is a schematic representation of a yarn passing around two driven vapor-heated rolls of the invention.

Referring to FIG. 1, the embodiment chosen for purposes of illustration includes a water-laden multifilament threadline 10 advancing from a source (not shown) to a pair of rotatably driven vapor-heated rolls 12, 12*a*. The rolls 12, 12*a* are substantially identical except that the longitudinal axis of 12*a* is skewed with respect to 12 to allow the threadline to spirally advance from the threadline entrance A at one end of the roll 12 to the threadline exit B at the other end of roll 12.

Figure 2:
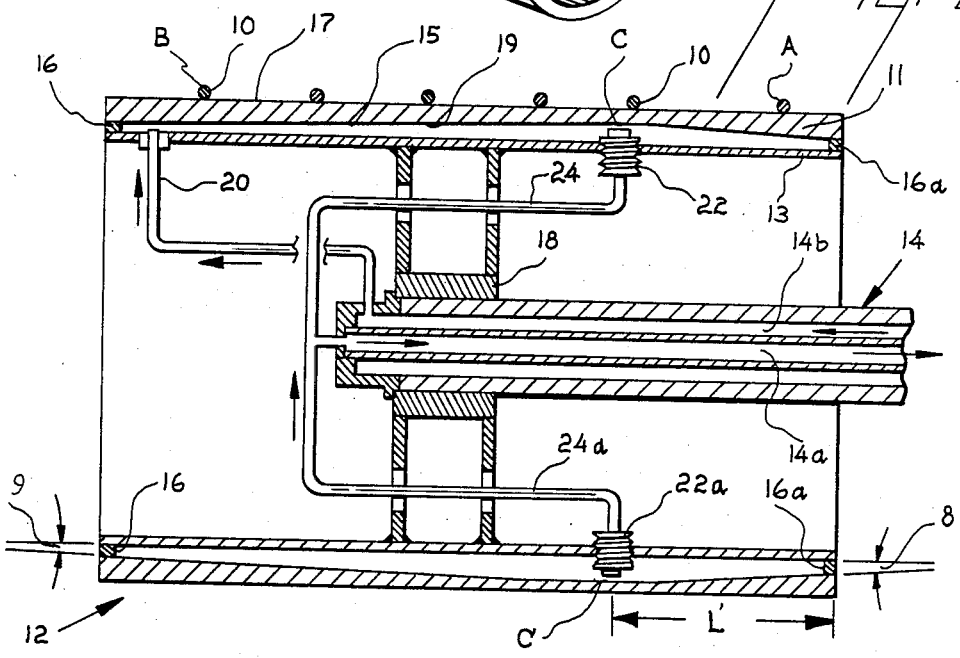
FIG. 2 is a side elevation view partially in section of one of the rolls in FIG. 1.

As best shown in FIG. 2, the roll 12 comprises first and second concentric cylindrical walls 11, 13, respectively, spaced from each other and sealed at each end by annular end plates 16, 16*a* to define an annular chamber 15 within the roll 12. The outer surface 17 of wall 11 constitutes the working surface of the roll and the location C. The angle of taper of wall 11 from the threadline entrance of the roll is designated 8 and the angle of taper from the threadline exit of the roll is designated 9. A rotatably driven support shaft 14 is attached in axial alignment with the roll to the inner wall 13 of the roll by means of bracket 18. The support shaft has concentric passages 14*a*, 14*b* passing therethrough. A pair of condensate removal nozzles 22, 22*a* are in communication with the passage 14*a* of shaft 14 via pipes 24, 24*a*, respectively. The nozzles 22, 22*a* are threaded through wall 13 for adjustability toward and away from surface 19 and located directly opposite each other, i.e., 180 degrees apart in chamber 15 adjacent location C. Optimum operation requires precise setting of the gap between nozzles 22, 22*a* and surface 19. If the gap is too small, rapid enough removal of condensate becomes impossible. If, on the other hand, it is too large, build-up of condensate will also occur. Gaps of about 1.8 mm are preferred. Wall surface 19 is flattened about position C enough that a uniform gap exists between the tips of nozzles 22, 22*a* and surface 19.

Steam or other vapor is introduced into chamber 15 through pipe 20 and an annular space or passage 14*b* surrounding condensate passage 14*a* passing through shaft 14.

Figure 3:
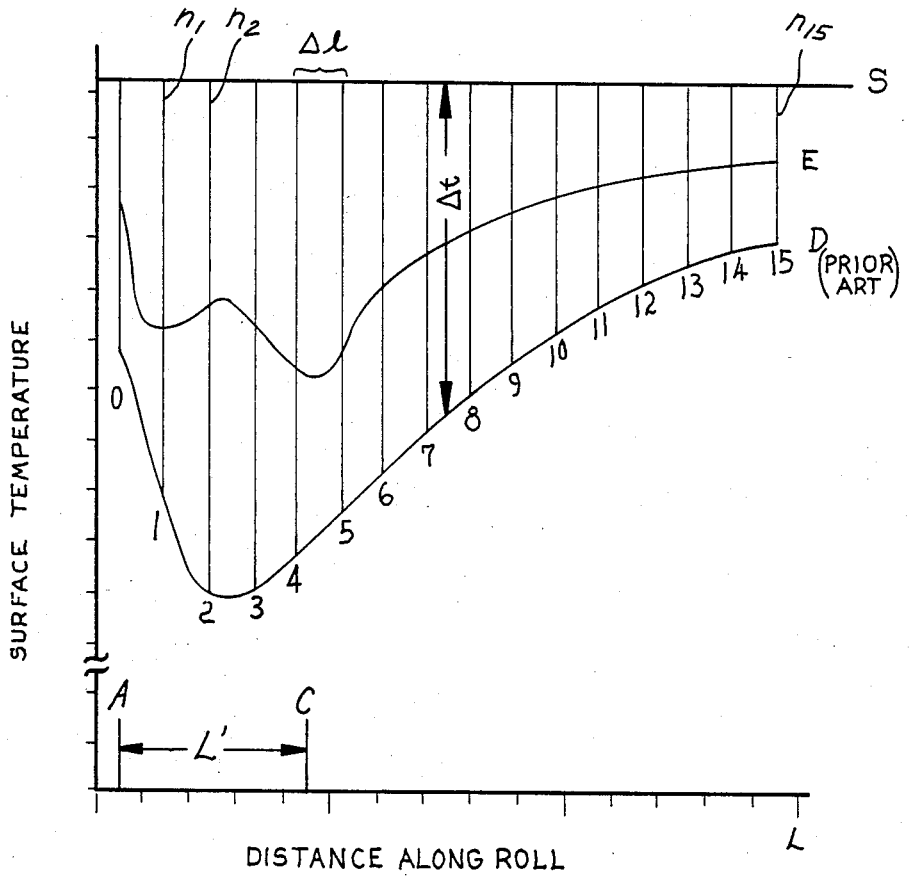
FIG. 3 is a graph of temperature profile along the length of the vapor heated roll of this invention as compared to a temperature profile of a prior art vapor heated roll.

The precise location at which the minimum thickness of wall 11 should be depends to some extent on the type of material being dried; so it cannot be uniquely specified. When a water-laden yarn is dried by multiple sprial wraps on a roll, such as known in the prior art with a single condensate removal pipe at the yarn entrance to the roll and a single steam input at the yarn exit from the roll, its temperature profile will be very much as shown by Curve D of FIG. 3, which plots roll-surface temperature against distance along the roll. For reference, line S shows the temperature of the feed steam. It will be observed that, at the filament entrance end of the roll (A), roll temperature is sharply depressed. Given this temperature profile, the location (C) of the siphon(s) and minimum wall-thickness according to this invention can be determined as follows.

Draw parallel lines numbered $n_1$–$n_{15}$ extending from line S to Curve D, each line equispaced from its next-adjacent lines by an increment, Δ1, of the total roll length. Total length, L, of the roll is then $$L = \sum_{0}^{n_{15}} (\Delta 1).$$

For each of the increments, compute average temperature, $(\Delta T)_n$, as $$(\Delta T)_n = (\Delta t_n - \Delta t_{n-1})/2.$$

Compute the total area as follows:

$$\sum_{n_1}^{n_{15}} (\Delta 1)(\Delta T)_n$$

Compute successively, as n increases $$\sum_{n_1}^{n} (\Delta 1)(\Delta T)_n$$

until its value is one-half of the total area. Interpolate in the final increment for a more precise determination of the length L′ at which the half-area is obtained. Locate the minimum wall thickness and siphon(s) at that length. In a preferred embodiment the length L′ is about 30% of the total length. Curve E shows the improved temperature profile of the roll surface using the roll of this invention, from which it can be seen that surface temperature is much closer to the temperature of the feed steam at every point along the surface. Regardless of the drying system involved, the distinct improvement of this invention will be obtained when the minimum wall-thickness and siphon(s) are within 20 to 40% of the roll length, measured from the threadline entrance on the roll.

Taper angles are not critical. The bigger the angle, the thicker must be the wall to accommodate it. On the other hand, best drainage action occurs when at least 0.5 degree of taper is employed. In a preferred embodiment, the taper angles 8, 9 are about 2 degrees and about 1 degree, respectively.

I claim:

1. A vapor heated roll for heating a material spirally advancing from an entrance at one end to an exit at the other end of the roll and wherein condensate is formed within said roll said roll comprising: first and second concentric cylindrical walls spaced from each other; an annular end plate attached to each end of said walls and enclosing a chamber within said roll; said first cylindrical wall having an outer surface constituting the working surface of the roll and an inner surface, said inner surface being tapered from each end toward a location within the chamber to provide a chamber having a gradually increasing cross-sectional area from each end of the chamber toward said location, said cross-sectional area changing continuously throughout the length of the chamber; to manage condensate movement within said chamber; a rotatable supporting shaft, attached to said second wall in axial alignment with said roll, said shaft having passages therethrough, one for condensate, one for heated vapor; a vapor-injection pipe in communication with said chamber and said heated vapor passage of said shaft; and a condensate removal pipe in communication with the condensate passage in the supporting shaft and said chamber at said location, said location being at a distance from said one end of the roll of about twenty to forty percent of roll length.

2. The roll of claim 1 wherein said distance to said location from said one end of the roll is about thirty percent of the roll length.

3. The roll of claim 1, said vapor being steam.

4. The roll of claim 1, wherein said inner surface of said first wall tapers from each end toward said location at an angle of at least 0.5 degrees.

5. The roll of claim 1 wherein the inner surface of said first wall tapers from a yarn entrance at one end of the roll to said location at an angle of about 2 degrees and said inner surface tapers from a yarn exit at the other end of the roll to said location at an angle of about 1 degree.

6. The roll of claim 1, there being two condensate removal pipes angularly spaced 180 degrees apart.

7. The roll of claim 6, there being one vapor injection pipe located adjacent the material exit end of the roll, said injection pipe being angularly placed intermediate the two condensate removal pipes.

8. The roll of claim 1 or 6, said condensate removal pipes being adjustable toward and away from the inner surface of said first cylindrical wall.

9. A steam heated roll for heating a yarn spirally advancing from an entrance at one end to an exit at the other end of the roll comprising: first and second concentric cylindrical walls spaced from each other; an annular end plate attached to each end of said walls and enclosing a chamber within said roll; said first cylindrical wall having an outer surface constituting the working surface of the roll and an inner surface, said inner surface being tapered from the yarn entrance of the roll at one end of the roll to said location at an angle of about 2 degrees and from the yarn exit at the other end of the roll to said location at an angle of about 1 degree to provide a chamber having a gradually increasing cross-sectional area from each end of the chamber to said location; a rotatable supporting shaft, attached to said second wall in axial alignment with said roll, said shaft having passages therethrough, one for condensate, one for heated vapor; a vapor-injection pipe in communication with said chamber and said heated vapor passage of said shaft; and a condensate removal pipe in communication with the condensate passage in the supporting shaft and said chamber at said location, said location being at a distance from said one end of the roll of about twenty to forty percent of roll length.

* * * * *

UNITED STATES PATENT AND TRADEMARK OFFICE

CERTIFICATE OF CORRECTION

PATENT NO. : 4,644,668

DATED : February 24, 1987

INVENTOR(S) : Robert E. Hull

It is certified that error appears in the above—identified patent and that said Letters Patent is hereby corrected as shown below:

Col. 2, line 48, insert after "and" -- inner surface 19 of wall 11 is tapered from each end of the roll toward a specified location C to provide the chamber 15 with a gradually increasing cross-sectional area from each end of the chamber to --.

Signed and Sealed this

Sixth Day of December, 1988

*Attest:*

*Attesting Officer*

DONALD J. QUIGG

*Commissioner of Patents and Trademarks*